US005588938A

United States Patent [19]

Schneider et al.

[11] Patent Number: 5,588,938

[45] Date of Patent: Dec. 31, 1996

[54] STRENGTH OF A MUSCLE TRAINING APPARATUS

[75] Inventors: Werner Schneider, Ermatingen; Hansueli Lerch, Steckborn; Erich Hausammann, Ermatingen, all of Switzerland

[73] Assignee: Fritz Gegauf AG Bernina Nahmaschinenfabrik, Steckborn, Switzerland

[21] Appl. No.: 344,645

[22] Filed: Nov. 18, 1994

[30] Foreign Application Priority Data

Nov. 30, 1993 [CH] Switzerland ..... 03 569/93

[51] Int. Cl.[6] ..... A63B 21/00

[52] U.S. Cl. ..... 482/4; 482/1; 482/5; 482/7; 482/92

[58] Field of Search ..... 482/1–9, 900–902, 482/92, 97, 110, 148

[56] References Cited

U.S. PATENT DOCUMENTS 3,387,493 6/1968 Strittmatter .
4,184,678 1/1980 Flavell .
5,186,695 2/1993 Mangseth et al. .
5,308,296 5/1994 Eckstein ..... 482/8 X
5,348,519 9/1994 Prince et al. ..... 482/6

FOREIGN PATENT DOCUMENTS

WO8801185 2/1988 WIPO .
WO9107214 5/1991 WIPO .

*Primary Examiner*—Richard J. Apley
*Assistant Examiner*—Glenn E. Richman
*Attorney, Agent, or Firm*—Richard Linn

[57] ABSTRACT

An extension arm (11) can be fixed to a column (2) at any height and with different inclinations. A foot holder (15, 16) is displaceably mounted on the extension arm and can be moved against the force of a traction cable (8) over the extension arm (11). A loading unit (4) programmable by means of an operating device (21) for selecting the load characteristics acts upon the traction cable. Alternatively, another extension arm for arm training can be mounted. Thus, different training varieties can be selected without the need of adjusting any weights or mechanisms. Different extension arms (11) may be provided which allow the adaptation of the apparatus to different training modes, such as leg, arm or body training.

19 Claims, 4 Drawing Sheets

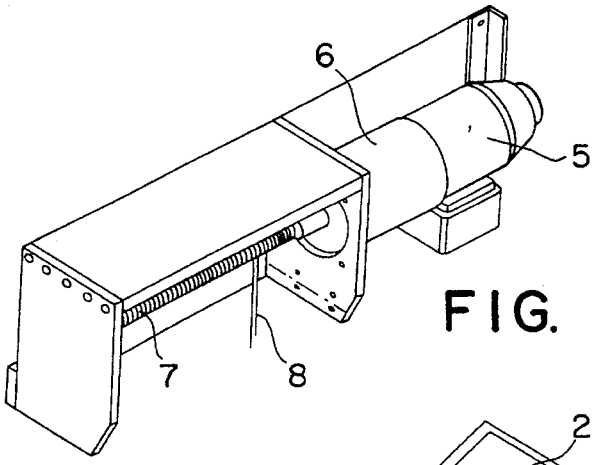
FIG. 2
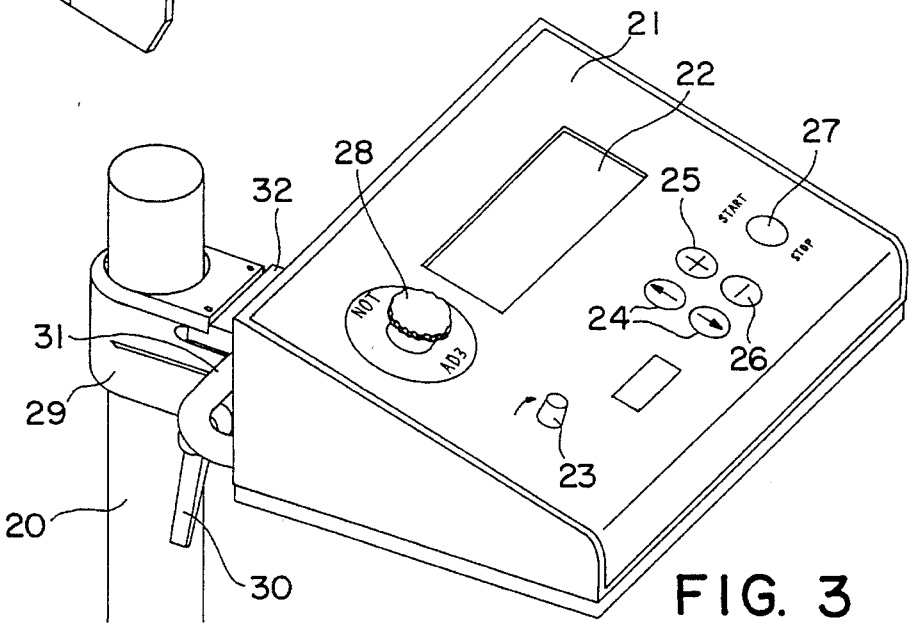
FIG. 3
FIG. 7
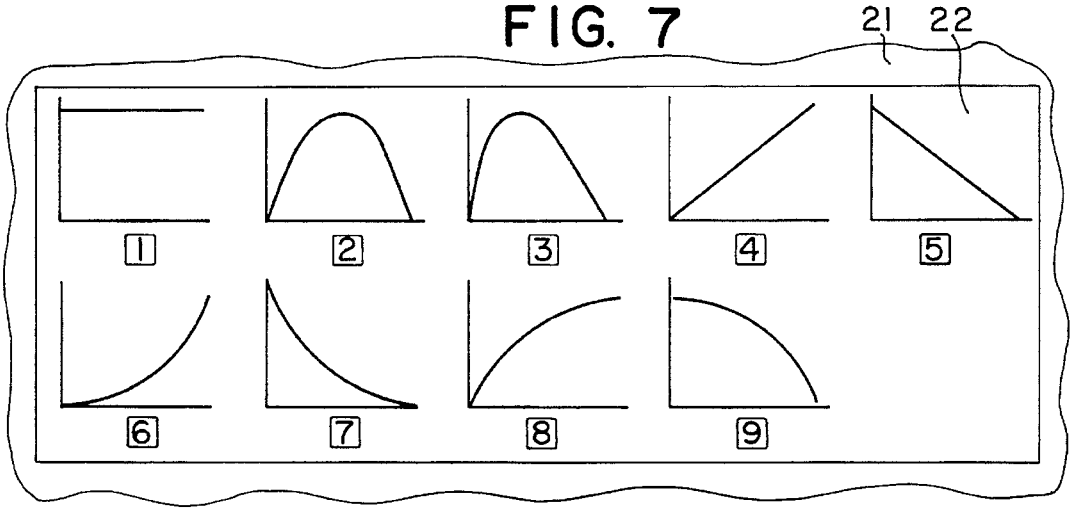

STRENGTH OF A MUSCLE TRAINING APPARATUS

The present invention is related to a strength or muscle training apparatus having engaging elements being under load and movable against said load by muscular power, and a programmable unit for the generation of said load.

BACKGROUND OF THE INVENTION

Such an apparatus is known from the document WO 91/07214. This known apparatus offers large possibilities of the design and the choice of training programs, i.e. of force to path characteristics and of speeds of movement. This apparatus, however, serves for the arm training only and therefore offers only limited application possibilities.

A training apparatus is also known from the document WO 88/01185 wherein engaging elements for the training of the legs or the arms may optionally be attached to a horizontal rest surface or to a vertical wall. The adjusting possibilities of the engaging elements are however very limited or even absent.

There is an object of the present invention to make possible most different training modes, e.g. leg training, arm training and body training, under optimal conditions by means of an apparatus and relatively simple accessories to this apparatus.

SUMMARY OF THE INVENTION

The object described above is met by the apparatus of this invention which comprises at least two extension arms which are attachable to a stand in selected positions, and at least one driving element which is connectable to One extension arm or one engaging element, respectively.

Preferably, the extension arms are attached to a column and can be adjusted as to their height and to their inclination, and they can be executed for being taken off or alternatively being attached in order to provide optimal conditions for all training modes.

The particular versatility of the adjustment and the position of the engaging elements calls for correspondingly versatile driving means. Preferably, a simple cable drive which can be shortened and lengthened at will is connected to the engaging element.

The invention is now explained in further detail by means of an embodiment which is represented in the drawing.

BRIEF DESCRIPTION OF THE DRAWINGS

In the drawing:

FIG. 2 shows the motor and the cable shaft for the generation of the load,

FIG. 3 shows an enlarged view of a portion of the operating device,

FIG. 7 shows a selection of possible load characteristics which are stored in the apparatus and can be selected.

DETAILED DESCRIPTION OF THE INVENTION

Figure 1:
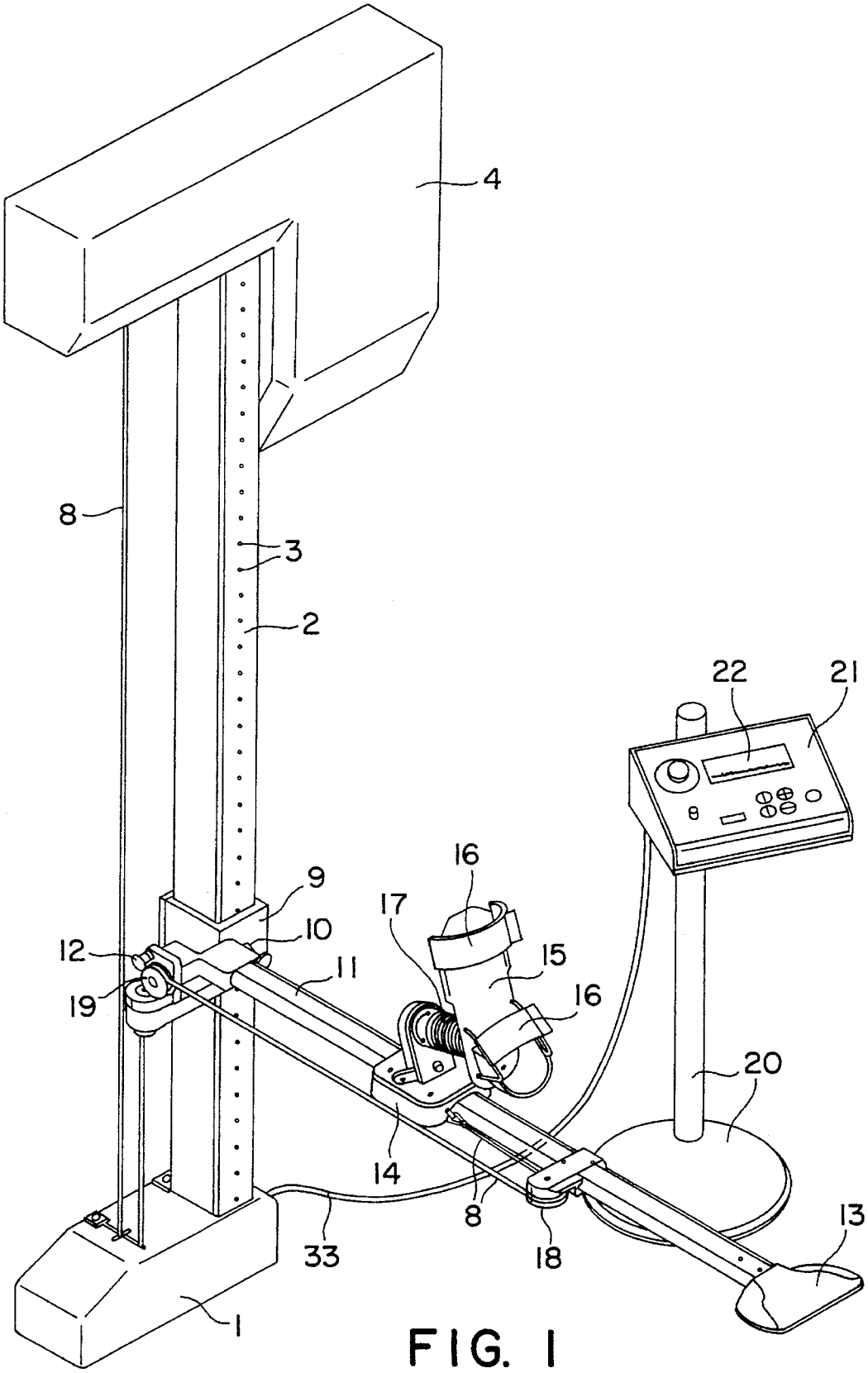
FIG. 1 shows the spatial total view of the apparatus.

A column 2 having a rectangular section and a row of holes 3 is connected to a base 1. The column 2 can be fixed to a wall according to FIG. 5. A housing 4 in which a motor for the generation of the load is lodged, is provided at the upper end of the column 2. This motor 5 is shown in FIG. 2. It acts either directly or through a gear 6 on a cable shaft 7 which is provided with a screw like cable groove. This cable groove serves for the single layer well-ordered winding up of a traction cable 8 with a force or a speed, respectively, which is determined by the motor 5.

A clamp 9 is vertically displaceable disposed on the column 2, and this clamp can be fixed by means of a pin 10 which engages one of the holes 3 through the clamp at any selected height on the column. An extension arm 11 is connected to the clamp 9, and this arm 11 can be pivoted over a certain range and can be fixed in a certain inclined position by means of a pin 12. A disk 13 is fastened at the outer end of the extension arm which serves for laying down the extension arm on a chair, the bed of a patient or similar, and on which the patient or the person under training can sit down. A slide 14 is displaceably seated on the extension arm 11, and a foot holder 15 having bands 16 which can be firmly attached to the foot or shoe by means of Velcro fasteners, is fixed to the slide 14 over a hinged support having adjustable stiffness. The end of the traction cable or rope 8 engages the slide 14 and is guided over a deflecting roller 18 on the extension arm 11, a second deflecting roller 19, and a third deflecting roller in the base 1 to the cable shaft 7. The traction cable 8 may however also be fastened directly to the slide 14 without using the deflecting roller 18 if traction forces are to be used during the training instead of pushing forces. The extension arm 11 can be executed for being separable from the clamp 9, or for being removable from the column 1 together with the clamp.

As shown in FIG. 3, an operating device 21 is mounted on a stand 20, the device having a monitor screen 22 and different operating elements, including a volume control 23, arrow keys 24 for selecting particular menues or parameters for the display on the screen 22, and a key (+) 25 and a key (–) 26. Furthermore, a start-stop key 27 and an emergency button 28 for the immediate switching off of the apparatus are provided. The function of the individual operating elements will be explained later on in connection with the electrical wiring diagram.

The operating device 21 is fixed to the column 20 by means of a clamp 29 which can be loosened and fastened by means of a clamping lever 30 in order to adjust the clamp 29 and thus the operating device 21 with respect to the stand 20 and to fasten it at the desired height and direction. The operating device 21 is further held by means of a frame 31 in a collet chuck 32. When this collet chuck 32 is released, the inclination of the operating device can be selected, and the chuck can then be tightened. Therefore, it is possible for the person under training to always monitor and operate the operating device by appropriate positioning of the stand 20 and the adjusting of the operating device 21. The operating device 21 is connected by an electric cable 33 to the other parts of the apparatus.

Figure 4:
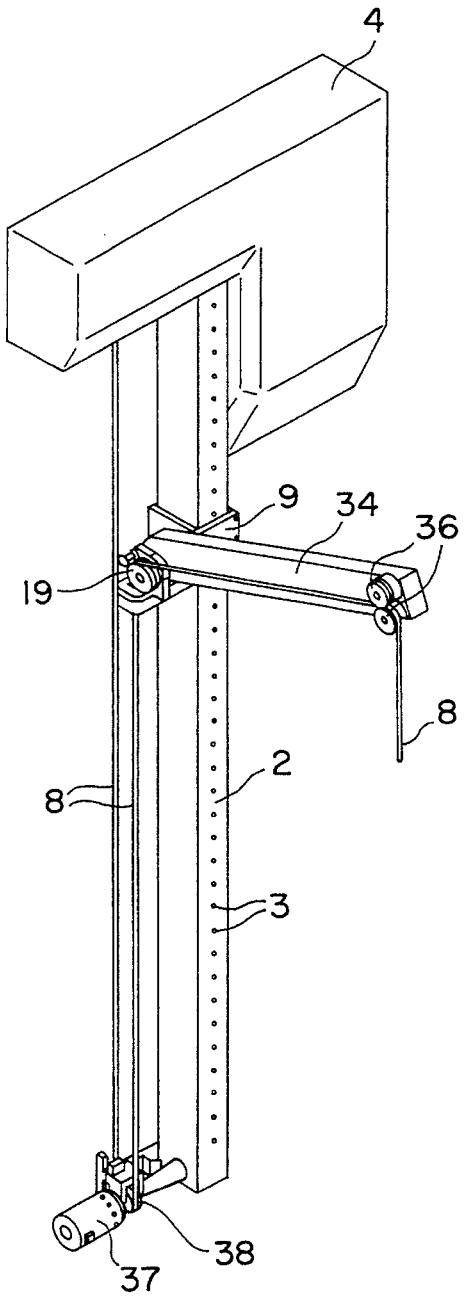
FIG. 4 shows the apparatus, provided with another extension arm.
Figure 5:
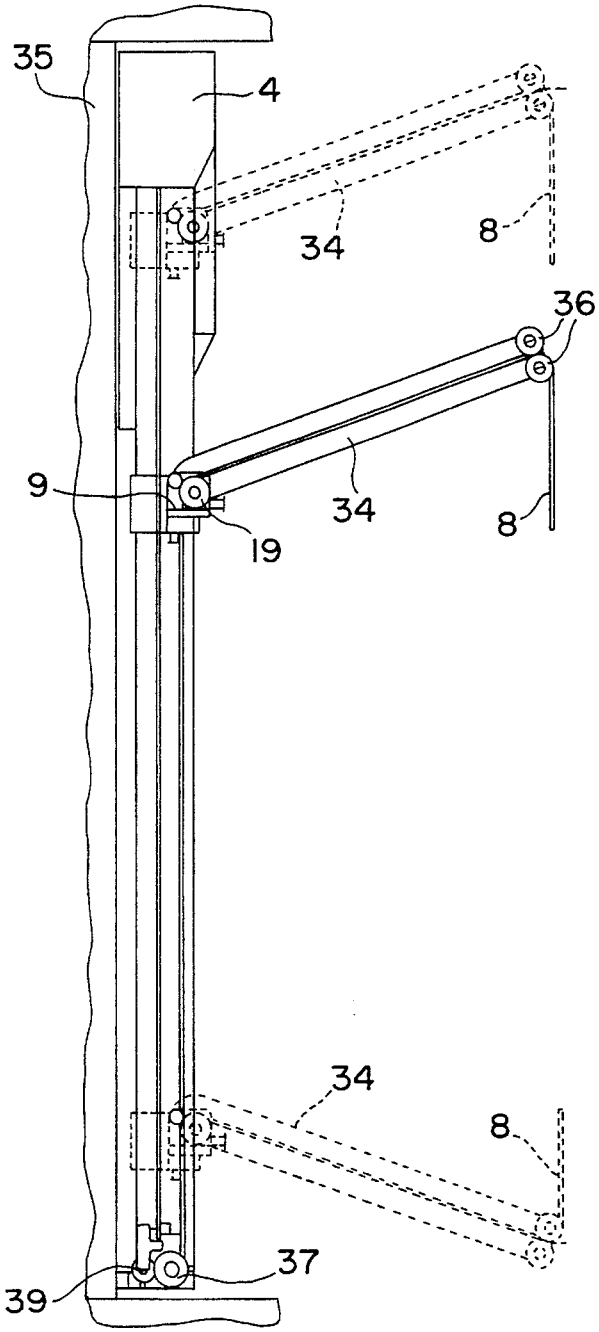
FIG. 5 shows the different application possibilities of the apparatus according to FIG. 4.

In FIG. 4 and 5, corresponding parts are referenced as in FIG. 1 to 3. The apparatus shown in FIG. 4 and 5 differs from theft according to FIG. 1 only by a slightly modified extension arm 34. The extension arm 34 is also pivotably arranged with respect to the clamp 9 and can be fixed in different positions as indicated in FIG. 5. FIG. 5 shows the mounting of the apparatus against a wall 35. It can be seen from FIG. 5 that the extension arm can be fixed at different heights and with different inclinations. The traction cable 8 is guided at this extension arm 34 over an inner deflecting roller 19 and around one of two outer deflecting rollers 36. Any desired engaging element such as a rod for the arm training or a kind of yoke for the body training can be fastened at the end of the traction cable 8. Thus, essentially the same apparatus may be equipped with two relatively simple, different extension arms for a variety of different training modes and can be correspondingly programmed.

As shown in FIG. 4 and 5, a tension motor 37 is lodged at the lower end of the column within the base 1 of the apparatus and this motor continuously exerts a certain torque on the lower deflecting roller 38 and thus maintains a certain tensible force on the end of the cable 8 running on the cable shaft 7, thus continuously providing a proper single layer winding up of the traction cable. A pressure roller 39 which pushes the traction cable against the deflecting roller 38 may be allocated to this deflecting roller so that, even when the cable is not loaded, the mentioned tensible force is present in the end of the traction cable running on the cable shaft 7.

Figure 6:
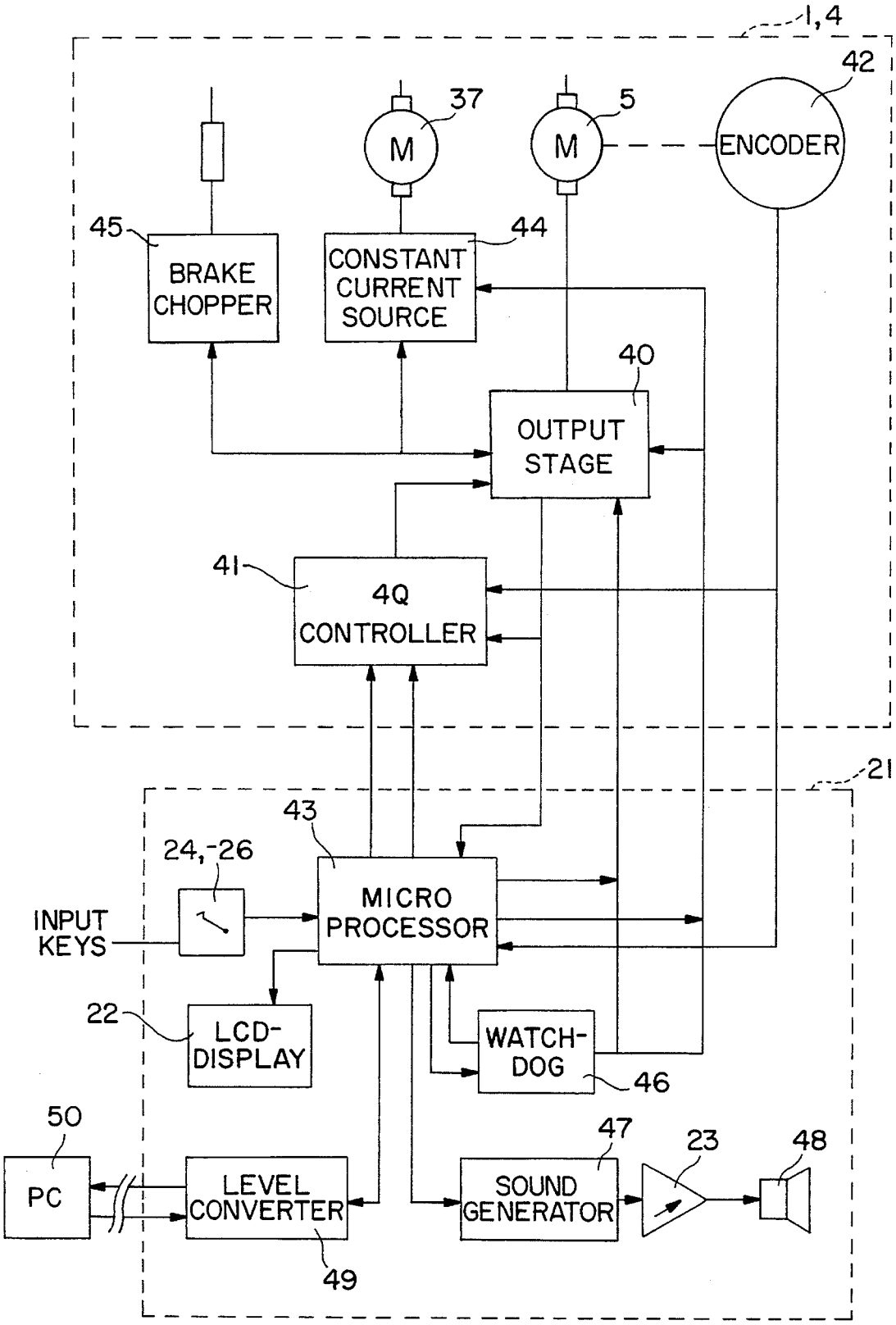
FIG. 6 shows the electric wiring or circuit diagram of the apparatus.

FIG. 6 shows the electrical connection diagram of the apparatus, and the different circuits will only be described in part as far as the functions are not directly obvious from the diagram. In FIG. 6 a difference is made between those circuits which are arranged in the parts 1 and 4 of the apparatus, and those circuits which are disposed within the operating device 21. The load motor 5 is connected to a power output stage 40 which receives different control signals. The control is effected in part indirectly by a four-quadrant controller 41 which is further supplied by certain control signals. An encoder 42 is connected to the motor or the cable shaft 7, respectively, which transmits the position of the motor or of the cable shaft 7, respectively, to a microprocessor 43 in the operating device 21. The tension motor 37 is supplied with a constant current from a constant current source 44 representing the constant tensible force of the cable 8. Both motors 5 and 37 are preferably direct current motors with a permanent magnet field so that their torque is essentially proportional to the motor current. The controller 41 adjusts the motor 5 in particular to a set value of the current or the torque, respectively, with respect to a supplied actual current value or, respectively, an actual rotational speed derived from the encoder signal. A brake chopper 45 prevents an excessive increase of the intercircuit tension when the motor is driven geometrically on pulling out of the cable. The braking function of the motor 5 is controlled by the microprocessor 43. A monitoring circuit 46 is provided which causes an automatic switching off when there are misfunctions of the electronics. Furthermore, a sound generator 47 is mounted which feeds a loudspeaker 48 through the controlled amplifier 23. Different parameters can acoustically be signalized, for example, the tone pitch may correspond to the actual speed with which the engaging element of the apparatus is operated. A level converter 49 may also be provided in the apparatus which allows the connection of the operating device, for example to a personal computer 50 and thus the storing of certain entire programs, through an appropriate interface. However, it is also possible to provide corresponding storage capacities and possibilities within the operating device itself so that certain training programs, for example programs allocated to a certain patient, can be selected and need not-be established each time from the beginning.

The programming of the apparatus is however made substantially easier by a predetermined menu technique. For example, it may be decided after switching on the apparatus whether an isokinetic or an isotonic training should be programmed. In response thereto, instructions are displayed on the monitor 22 for the adjustment of certain parameters. For an isotonic training,it is first displayed that the traction force should be selected. By means of the keys 25 and 26, the traction force may then be raised or diminished, and when the desired force is displayed, one of the keys 24 may be hit for storing this traction force. Then, for example, the braking force is asked for, and the entry may be given by the keys 25 and 26. Afterwards, the force gradient or the force to path characteristic, respectively, is requested, the menu according to FIG. 7 being displayed. Here again, the desired number can be selected with the keys 25 and 26 and will be stored when the selection is continued. As shown in FIG. 7, a variety of different characteristics are possible, e.g. constant force according to curve 1 or linear increasing or decreasing force according to curves 4 or 5, etc. Of course, the characteristics of FIG. 7 are to be understood as being examples only, and many other characteristics are also possible. When the characteristic has been selected, the cycle time and the number of cycles may also be selected and stored. Furthermore, the reversal points of the movement can be determined and stored. To this end, the engaging element, for example the foot holder of FIG. 1, can be pulled from the zero position where the cable is totally wound up, into a first reversal position, the load motor being controlled for weak load. The encoder 42 reports this position to the microprocessor, and it may be stored, for example in hitting the key 25. The foot holder can then be brought again into the second reversal or stop position, and this position may be stored too. The apparatus is now programmed and training with the apparatus can begin. In a corresponding way, other training modes may be selected and stored. For example, isokinetic training is possible wherein the speed, the force and the number of cycles may be selected beforehand. As mentioned above, the reversal and stop positions may be fixed whereupon the apparatus is ready for operation.

Means may also be provided to enter and to store set values, for example a strength to be obtained by a longer training and to compare during training each set value with the actual value obtained and to display which percental part of the set value has been obtained.

As mentioned above, the load motor 5 takes over the function of weights in conventional training apparatuses. In response to the current supplied to this motor, a certain traction force acts on the traction cable or rope 8 which must be overwhelmed by the person under training. The reversal or stop positions mentioned above are simulated in that the motor current is temporarily considerably increased or lowered. If, for example, the foot holder 15 is displaced against the tensible force of the cable 8 to the left in FIG. 1, the end of this movement is determined by considerably increasing the motor current and thus the resistance, and the person in training then knows that it should now move the foot holder in the opposite direction, i.e. concurrently with the cable traction. At the other end of the stroke, the motor current and thus the cable traction may be temporarily reduced which is sensed by the person in training, and which automatically results in a reversal of the direction of movement. However, a purely mechanically brake could have been provided which enters into action at every reversal point and lowers the movement down, and the person in training will know that the direction of movement must be reversed. The electrical determination of the reversal points presents however the advantage that no shock-like decelerations will occur.

It should be noted that it is scarcely possible to control speed and force by the motor 5 at the same time. The isotonic training mentioned above comprises a force control, i.e. the force gradient dependent from the path can be selected whereas the speed of movement can de determined by the person in training. Inversely, the speed of movement is controlled in isokinetic training whereas the user may select the force at will.

Different embodiments are possible. Instead of a PC, a key may be connected to the interface of the operating device mentioned above which allows to store at least one particular program. Such a key could then be attributed to a certain person which may then enter the program adapted to her or him by means of this key, and then perform the training. The traction cable or rope used in the described embodiment raises certain problems in that it can only loaded with tensible forces and not with pressure ones, and because measures must be taken to always guarantee a smooth and ordered winding up of the cable. Therefore, a direct drive of the engagement element, for example the foot holder according to FIG. 1, might be foreseen, e.g. by a toothed bar and a pinion. Such a linear driving unit could then be constructed as an extension arm. In some cases, an endless cable or chain could be used which enables the arrangement to transmit forces in two directions. In place of a direct current motor, asynchronous motor could be used. The choice of the speed could also be selected by means of a control element together with the tone pitch. The apparatus can also be u ed without the extension arms 11 or 34, respectively, by attaching an appropriate engaging element directly to the traction cable guided over the deflecting roller 19.

The operating device may also be mounted on a stand, for example on a simple tube frame. The front plate of the operating device may have an inclination of e.g. 17° . The frame may be designed in such a manner that it can be brought by 90° from a vertical into a horizontal position where the operating device can be viewed by a person lying down.

We claim:

1. A strength or muscle training apparatus comprising engaging elements for arm and foot training, program-controllable driving means for moving and loading said engaging elements, extension arms carrying said engaging elements, a supporting structure having a plurality of coupling means at different levels for attachment of each of said extension arms at a selectable fixed level of said supporting structure, the apparatus thus being adaptable for a wide variety of training conditions.

2. The apparatus of claim 1, wherein a direct current motor (5), acts on the engaging elements (15).

3. The apparatus of claim 2, wherein the motor (5) acts by means of a traction cable (8) on the engaging elements (15).

4. The apparatus of claim 3, wherein the motor (5) acts on a cable shaft (7) having a screw-shaped cable groove, and wherein a tensioning element, e.g. a tensioning motor (37), always maintains tensioned the cable end running to or from, respectively, the cable shaft (7).

5. A strength or muscle training apparatus according to claim 1, wherein said supporting structure is a column (2) on which at least two extension arms (11, 34), each bearing an engaging element (15) are adjustably fastenable with respect to height and inclination.

6. The apparatus of claim 5, being provided with a first extension arm (11) having a displaceable foot holder (15), and with a second extension arm (34) for arm and body training.

7. The apparatus of claim 6, wherein said first extension arm (11) contains a supporting plate (13) for laying the extension arm down on a support such as chair or bed.

8. The apparatus according to claim 1, further comprising an operating device (21) which is adjustable as to height, direction and inclination and thius being visible from any training position whatsoever.

9. The apparatus according to claim 8, wherein the operating device (21) is disposed at a stand (20) separated from said column (2), or a frame being usable in two positions is provided together with said operating device (21).

10. The apparatus according to claim 5, wherein said programmable unit (4) is disposed at the upper end of said column (2) and is connected to the said engaging element (15) via a deflecting roller (38) at the lower column end and at least one deflecting roller (19, 18, 36) on an extension arm (11, 34).

11. The apparatus according to claim 1, further comprising a microprocessor (43) for selecting and entering of parameters and for controlling said program-controllable driving means, input keys (24 to 26), and a display (22), keys (24) being provided for selecting and displaying of menus and keys (25, 26) for the adjusting of parameters such as force, force gradient, path or stroke, cycle time and braking force.

12. The apparatus according to claim 1, further comprising a brake installation, e.g. a brake circuit allowing to supply a braking current to the braking unit (5), stop or reverse positions of the stroke of an engaging element (15) being determined by braking or relief of the braking unit (5).

13. The apparatus of claim 12, further comprising input means (25, 42, 43) for the stop or reversal positions which store these positions when an engaging element (5) has been brought into these positions and is actuated.

14. The apparatus of claim 11, further comprising an encoder (42) connected to said microprocessor (43) for determining and transmitting the position of the engaging elements (15).

15. The apparatus according to claim 1, further comprising a sound generator (47) and loudspeakers (48) for the acoustical monitoring of the movement of the engaging elements (15).

16. The apparatus according to claim 1, further comprising means for storing certain programs, e.g. personal one, these means being for example an interface for the connection of a personal computer (50) or a pluggable storage key or internal memories of the apparatus.

17. The apparatus according to claim 11, further comprising means for storing of at least one set value of a parameter, such as force, path or speed, and means for comparing the actual value obtained during training with the set value and for displaying and/or storing the difference between set and actual value or the relation between set and actual value.

18. A strength or muscle training apparatus comprising engaging elements for arm and foot training, program-controllable driving means for moving and loading said engaging elements, extension arms carrying said engaging elements, a supporting structure having a plurality of coupling means at different positions for attachment of each of said extension arms at a selectable fixed position of said supporting structure, one of said extension arms having a displaceable foot holder adapted for substantially horizontal movement along said extension arm, said one extension arm comprising supporting means for applying it onto a supporting device.

19. A strength or muscle training apparatus comprising engaging elements for arm and foot training, program-controllable driving means for moving and loading said engaging elements, extension arms carrying said engaging elements, a supporting structure having a plurality of coupling means at different positions for attachment of each of said extension arms at a selectable fixed position of said supporting structure, said driving means comprising a motor, a cable shaft coupled with said motor, a traction cable wound onto said cable shaft and having means at its free end for attaching it to one of said engaging elements, a tensioning motor coupled with said cable and energized for continuously tensioning said cable running to and from said cable shaft.

* * * * *